United States Patent [19]

Cook, Jr. et al.

[11] 4,042,034

[45] Aug. 16, 1977

[54] METHOD FOR INCREASING THE RECOVERY OF NATURAL GAS FROM A GEO-PRESSURED AQUIFER

[75] Inventors: Harold L. Cook, Jr.; Ernest C. Geer, both of Houston, Tex.

[73] Assignee: Transco Energy Company, Houston, Tex.

[21] Appl. No.: 689,622

[22] Filed: May 24, 1976

Related U.S. Application Data

[63] Continuation-in-part of Ser. No. 589,300, June 23, 1975, abandoned.

[51] Int. Cl.[2] ..... E21B 43/00

[52] U.S. Cl. ..... 166/314

[58] Field of Search ..... 166/314, 268, 273–275, 166/263, 245, 265, 267, 252; 175/50

[56] References Cited

U.S. PATENT DOCUMENTS

| | | | |
|---|---|---|---|
| 2,077,912 | 4/1937 | VanVoorhis | 166/265 |
| 3,215,198 | 11/1965 | Willman | 166/274 X |
| 3,302,581 | 2/1967 | Burch | 166/314 |
| 3,382,933 | 5/1968 | Hottman | 175/50 |
| 3,785,446 | 1/1974 | Fertl et al. | 175/50 |

OTHER PUBLICATIONS

Amyx et al., "Petroleum Reservoir Engineering, Physical Properties," McGraw-Hill Book Co., Inc., N.Y., 1960, pp. 14–16.

Muskat, "Physical Principles of Oil Production," McGraw-Hill Book Co., Inc., N.Y., 1949, pp. 364–369.

Szilas, "Production and Transport of Oil and Gas," Elsevier Scientific Publishing Co., N.Y., 1975, pp. 242, 243, 252–254.

*Primary Examiner*—Stephen J. Novosad

*Attorney, Agent, or Firm*—Fulbright & Jaworski

[57] ABSTRACT

A method of increasing the recovery of natural gas from a geo-pressured aquifer containing water and gas and having a zone of free gas dispersed in water, by providing one or more wells extending from the surface to and completed in the geo-pressured aquifer in said zone and allowing the aquifer to flow water and gas under natural pressure through the well and lowering the pressure in the aquifer sufficiently to allow the gas to be released from solution in the water whereby the gas released will migrate more freely to the well and be produced. Also, any gas-phase saturation in the aquifer and any deposit of gaseous hydrocarbons in the formation in pressure communication with the wells will expand due to lowered aquifer pressure and be encouraged to flow to the wells and be recovered. Preferably, the wells are produced at a high enough rate of production to reduce the existing aquifer pressure in the drainage area of the wells as quickly as possible so that gas may be released from solution in the water and so that gaseous hydrocarbons in the formation may expand and flow to the wells. A high initial flow rate of at least 15,000 barrels of water per day from each well is necessary to effect the lowering of the aquifer pressure by at least 25% in order to provide the necessary mobility of the gas to obtain the enhanced gas recovery by the present method.

10 Claims, 11 Drawing Figures

WATER-FILLED SAND HAVING
GAS DISSOLVED IN THE WATER

SAND, WATER CONTAINING DISSOLVED
NATURAL GAS BUBBLES (DISPERSED GAS)

GAS SATURATION: 10% TO 35% OF PORE VOLUME
WATER SATURATION: 90% TO 65% OF PORE VOLUME

10 MILE DIAMETER LARGE AQUIFER
8 WELLS

DAILY GAS PRODUCTION, MMscf/D

| YEAR | CASE 1 ORIGINAL G/W RATIO | CASE 2 GAS MIGRATION MAXIMUM | DAILY WATER PRODUCTION STD. BBL./D |
|---|---|---|---|
| 1 | 11.84 | 22.44 | 400,000 |
| 2 | 11.84 | 47.56 | 400,000 |
| 3 | 11.84 | 84.84 | 400,000 |
| 4 | 11.84 | 83.44 | 400,000 |
| 5 | 11.54 | 80.39 | 390,000 |
| 6 | 11.10 | 75.98 | 375,000 |
| 7 | 9.84 | 66.20 | 332,500 |
| 8 | 8.88 | 59.10 | 300,000 |
| 9 | 8.07 | 53.14 | 272,500 |
| 10 | 7.33 | 47.77 | 247,500 |
| 11 | 6.66 | 42.98 | 225,000 |
| 12 | 6.08 | 38.84 | 205,500 |
| 13 | 5.57 | 35.34 | 188,000 |
| 14 | 5.06 | 31.98 | 171,000 |
| 15 | 4.62 | 29.02 | 156,000 |
| CUM. TOTAL PRODUCTION | 48,220 MMscf | 291,639 MMscf | $1,629 \times 10^6$ BBL. |
| RECOVERY FACTOR * | 2.23% | 13.51% | 2.61% |
| RECOVERY PER WELL | 6,028 MMscf | 36,455 MMscf | $203.6 \times 10^6$ BBL |

TOTAL GAS EVOLVED IN RESERVOIR = 430,955 MMscf

* ORIG. SOLUTION GAS-IN-PLACE = $2.159 \times 10^9$ scf (2.1 TRILLION CU. FT.)
ORIG. WATER IN PLACE = $62.392 \times 10^9$ BBL. (62 BILLION BBL.)

Fig. 6

PRODUCTION HISTORY, 3 MILE RADIUS RESERVOIR

DAILY GAS PRODUCTION, MMscf/DAY
0
1
2
3
4
5
6
7
8
9
10
11
12
13
14
15
16
17
18
CASE 2 : GAS MIGRATION MAXIMUM CASE
CASE 1 : INITIAL GAS / WATER RATIO
1
2
3
4
5
6
7
8
9
10
YEAR

3 MILE DIAMETER AQUIFER
2 WELLS

DAILY GAS PRODUCTION, MMscf/D

| YEAR | CASE 1 ORIGINAL G/W RATIO | CASE 2 GAS MIGRATION MAXIMUM | DAILY WATER PRODUCTION |
|---|---|---|---|
| 1 | 2.96 | 3.70 | 100,000 |
| 2 | 2.96 | 11.57 | 100,000 |
| 3 | 2.59 | 17.54 | 87,500 |
| 4 | 1.92 | 12.63 | 65,000 |
| 5 | 1.41 | 9.04 | 47,500 |
| 6 | 1.04 | 6.52 | 35,000 |
| 7 | 0.80 | 4.98 | 27,000 |
| 8 | 0.62 | 3.83 | 21,000 |
| 9 | 0.46 | 2.79 | 15,500 |
| 10 | 0.30 | 1.79 | 10,000 |
| CUM. TOTAL PRODUCTION | 5,496.9 MMscf | 27,152.4 MMscf | 185,600,000 BBL. |
| RECOVERY FACTOR * | 2.82 % | 13.98 % | 3.3 % |
| RECOVERY PER WELL | 2,748 MMscf | 13,576 MMscf | 87,800,000 BBL. |

TOTAL GAS EVOLVED IN RESERVOIR = 48,850 MMscf

* ORIG. SOLUTION GAS-IN-PLACE = $1.943 \times 10^{11}$ scf (194 Bcf)
ORIG. WATER IN PLACE = $5.615 \times 10^{9}$ BBL. (5.6 BILLION BBL.)

Fig. 8

GAS RESERVOIR
PLAN VIEW

WATER INVADED GAS RESERVOIR
2 WELLS

GAS PRODUCTION MMsef / Yr.

| YEAR | CASE 1 ORIGINAL GAS/WATER RATIO | CASE 2 GAS MIGRATION MAXIMUM | WATER PRODUCTION Bbl. per Yr. |
|---|---|---|---|
| 1 | 467.2 | 8,664 | 14,600,000 |
| 2 | 1,168.0 | 3,209 | 36,500,000 |
| 3 | 1,168.0 | 2,022 | 36,500,000 |
| 4 | 1,004.5 | 1,444 | 31,390,000 |
| 5 | 771.2 | 1,153 | 24,100,000 |
| 6 | 584.0 | 1,008 | 18,250,000 |
| CUM. TOTAL PRODUCTION | 5,162.9 | 17,500 | 161,340,000 |

| | | |
|---|---|---|
| REMAINING FREE-GAS IN RESERVOIR | 13,187 | MMsef |
| RESIDUAL GAS IN RESERVOIR | 24,440 | MMsef |
| SOLUTION GAS IN RESERVOIR WATER | 1,900 | MMsef |
| TOTAL GAS IN RESERVOIR | 39,527 | MMsef |

GAS RECOVERY FACTOR 44%

Fig. 11

METHOD FOR INCREASING THE RECOVERY OF NATURAL GAS FROM A GEO-PRESSURED AQUIFER

RELATED APPLICATIONS

This application is a continuation-in-part of copending application Ser. No. 589,300, filed June 23, 1975, now abandoned.

BACKGROUND OF THE INVENTION

There exist, particularly along the Coast of the United States bordering the Gulf of Mexico, geo-pressured aquifers or water reservoirs containing water and natural gas, which exist at pressures substantially higher than hydrostatic pressure. The geo-pressured aquifers, when in communication with a well bore, will flow water to the surface of the ground in artesian fashion.

These geo-pressured aquifers are known to contain natural gas dissolved in the water and while the total quantity of such gas reserves stored in these aquifers is not known with precision, various estimates range upward to 4,500 trillion cubic feet of gas. Natural gas may be present in geo-pressured aquifer formations in the form of (1) gas dissolved in the water, and also in the form of (2) a free-gas phase dispersed with water within the sand pores. An additional form of natural gas may exist in depleted and non-commercial geo-pressured gas reservoirs where (3) a free-gas phase is present separate from water. It is estimated that the recovery of water by artesian flow from such a bounded aquifer is in the range of 3% of the water contained in the bounded aquifer. If gas exists in such a bounded aquifer in solution with the water (form 1), the recovery of gas has been estimated by others to be the same 3% range which is not sufficient to make drilling of wells commercially successful. Geo-pressured aquifers having a dispersed free gas phase (form 2) generally contain a larger quantity of gas than aquifers containing only solution gas, but the amount of free gas in such aquifers cannot be conventionally recovered because of the co-production of large quantities of water. Natural gas production from commercial geo-pressured gas reservoirs frequently ceases because of large quantities of water production interfering with gas recovery. In addition, many geo-pressured reservoirs where gas production has been discontinued due to water interference with producing wells contain deposits of gas-phase gas (form 3) unrecovered but in pressure communication with existing wells.

The present invention is directed to producing water from wells completed in geo-pressured aquifers so as to maximize the recovery of natural gas from these formations. The conventional method of producing hydrocarbon fluids from oil or gas wells is to limit the rate of flow such that the formation pressure in the vicinity of the well is not reduced drastically so that water is not drawn into the well bore in appreciable quantities. On the other hand, the present invention is directed to producing water from the wells in an area of the reservoir having a dispersed free-gas saturation (form 2) at a high production rate so as to reduce the formation pressure significantly and preferably as quickly as possible whereby a significant fraction of the gas dissolved in the water contained in the aquifer is disdissolved (released from solution in the water). The natural gas, released from the water that remains in the aquifer, can then flow to the well independent of the flow of water and be recovered when a small free-gas phase is dispersed within the aquifer, because natural gas flows through the formation more easily than water due to the extreme contrast in viscosity of the two materials and due to the favorable gas/water permeability ratio.

The present invention is directed to a method which may produce as much as 14% of the gas in a geo-pressured aquifer as compared to present estimates of a recovery of only 3% by conventional methods.

SUMMARY

The present invention is directed to a method of increasing the recovery of natural gas, principally methane, from a geo-pressured aquifer containing water and gas and having a zone of free gas dispersed in the water by providing one or more wells extending from the surface and completed in the geo-pressured aquifer in said zone and allowing the geo-pressured aquifer to flow water and gas, under natural pressure, through the well so as to lower the pressure in the aquifer sufficiently to allow gas to be released from solution with the water whereby the released gas will migrate more freely than the water to the well and be produced and the gas recovered at the surface. The water flowing from the reservoir will do so under its own pressure and therefore does not require pumping to produce. Furthermore, because of the separation of a part of the gas from the water in the subsurface formation, a greater percentage or prorata portion of gas may be produced than that of water. Only a small percentage of the water in the aquifer need be produced to significantly lower the aquifer pressure to allow the gas in solution to be released from the water.

A further object of the present invention is the method of enhancing the recovery of natural gas from a geo-pressured aquifer by providing one or more wells extending from the surface and completed in the geo-pressured aquifer and producing water from the wells by natural pressure at a high enough rate of production to reduce the working bottom-hole pressure of the wells by at least 25% to allow the gas to be released from solution in the water, most of which water remains in the aquifer, such gas will migrate to the wells independent of the water.

Still a further object of the present invention is to allow the initial flow rate from each of the wells to be at least 15,000 barrels of water per day to provide the desired aquifer pressure reduction and to maintain this reduced pressure.

Yet a further object is the use of the present invention in a geo-pressured gas reservoir depleted of gas production by conventional means from wells whereby the reduction in pressure allows the unrecovered free-gas phase to expand and become recoverable through the wells.

A further object is the use of the present invention by utilizing existing wells and/or new wells as required by the aquifer to be produced.

Another object is the provision of lowering of the pressure in as short a time as possible thereby reducing the total water production required for gas recovery and requiring the disposal of less water.

A further object is to obtain increased enhanced gas recovery by lowering the pressure at the bottom of the well as quickly as possible. The time required for this pressure reduction in some aquifers may be as great as one or two years and is dependent on water flow rate and aquifer characteristics.

Still a further object of the present invention is to obtain enhanced natural gas recovery from geo-pressured aquifers having dispersed free-gas saturation in the water-filled formation (form 2) which contain gas dissolved in water (form 1) and/or aquifers which include a free-gas phase but which were considered non-commercial or were depleted by commercial production. While there is a larger quantity of gas dissolved in water (form 1) because of the great total volume of water in aquifers having gas dissolved in water, there is a much greater opportunity for higher gas recovery per barrel of water produced when using the present method with the aquifers having gas in forms 2 and 3.

Other and further features and advantages will be readily apparent from the following description of a preferred embodiment.

DESCRIPTION OF THE DRAWINGS

FIG. 6 is a table showing the production rates of gas and water under the two conditions illustrated in FIG. 5, FIG. 8 is a table showing the production rates of gas and water under the two conditions illustrated in FIG. 7, FIG. 11 is a table showing the production rates of gas and water under the two conditions illustrated in FIG. 10.

DESCRIPTION OF THE PREFERRED EMBODIMENT

Figure 1:
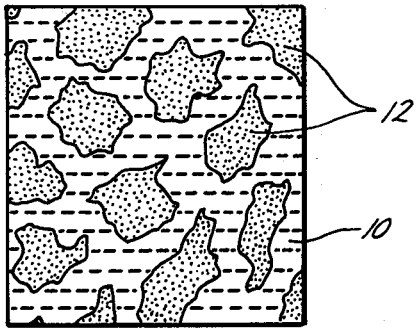
FIG. 1 is an enlarged cross-sectional view of a portion of a geo-pressured aquifer in which natural gas is dissolved in the water in the sand pores (form 1)

FIG. 1 illustrates a portion of a geo-pressured aquifer of form 1 in which the natural gas, primarily methane, is dissolved in the water in the sand pores. Thus, the water 10 containing dissolved natural gas completely fills the pores between the sand particles 12. U.S. Pat. Nos. 3,258,069 and 3,330,356 suggest removing entrained gas and various studies that have been directed to the exploitation of geo-pressured aquifers for recovery of thermal and hydraulic energy contained in the water 10 have agreed that only the dissolved gas in the water which is produced from the wells is available and that this gas is available but only at the original solution gas/water ratio. Well drilling cost, investment for surface piping and equipment, and operating costs make such a volume of gas recovery economically questionable under conventional practices. Furthermore, since only about 3% of the water could be recovered from an aquifer under aquifer pressure by artesian flow, this would mean that essentially 97% of the water and gas would remain unrecovered in the aquifer. While various estimates of the potential gas reserves stored in formations such as shown in FIG. 1 are speculative, they range upward to 4,500 trillion cubic feet of gas. The present method is directed to attaining not merely the 3% of the natural gas previously believed available, but to obtain as large a percentage as possible of the total original natural gas reserve, and applicants have determined that as large a percentage as 14% can be recovered by the present method which would make the recovery commercially feasible.

While it has been suggested in hearings before the Subcommittee on Energy of the Committee on Science and Astronautics before the U.S. House of Representatives, 93rd Congress, Second on Feb. 5, 6, 7, 11, 1974 concerning Hr 11212, that there is the possibility of some release of solution gas from the water in an aquifer as the pressure is reduced, there has been no suggestion that any of this natural gas evolved could be economically recovered. Of prime importance in the recovery of natural gas from a geo-pressured reservoir is whether or not the natural gas evolved in the aquifer remote from wells will be able to migrate to a well and be produced. Various laboratory investigations of gas movement in water-filled sands with low volumetric saturations of the gas phase have indicated that the gas phase will not be mobile. There is some minimum value of "free gas" saturation required in the formation pores above which saturation the gas becomes mobile, that is, can move through the formation in response to differences in pressure. Also buoyancy forces due to the difference between the density of gas and water may become operable in concentrating the free-gas saturation and allowing gas to move through the sand.

Figure 2:
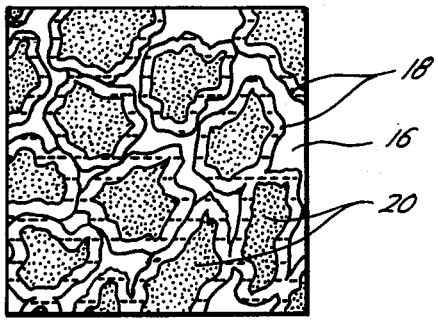
FIG. 2 is an enlarged cross-sectional view of a portion of a geo-pressured aquifer having a dispersed free gas (form 2) such as found in watered-out gas reservoirs or non-commercial gas reservoirs as well as gas dissolved in the water (form 1)

Some geo-pressured aquifers contain both continuous (form 3) and dispersed gas-phase saturation (form 2) considered marginal or non-commercial for water-free gas production. Referring to FIG. 2, a cross-sectional view of a portion of such a reservoir is shown in which the natural gas 16 is in a gas phase surrounded by water 18 in the pore spaces between the sand particles 20 (form 2). As indicated on the drawing, the amount of gas relative to water may vary. In addition, the water 18 will include natural gas in solution (form 1) with the water 18. If a gas-phase saturation (form 2) exists in the aquifer initially, upon reduction of aquifer pressure, the natural gas evolved from the water (form 1 gas which changes to form 2 gas) in the formation becomes mobile. The expansion of the gas-phase gas (form 3) also migrates to the wells and is recovered.

The present invention is directed to producing the water from a geo-pressured aquifer having dispersed free-gas saturation (form 2), using aquifer pressure, at a high rate of flow in order to reduce the pressure of the aquifer sufficiently so that the solution gas (form 1) will become liberated from the water and will become mobile, free to flow to the producing well independent of the water flow and be recovered. This will allow solution gas recovery from water not produced. In addition, any liquid hydrocarbons present in the aquifer will flow to the well and will be recovered along with the gas and water. As has been indicated in connection with the description of FIG. 1, for natural gas dissolved in water in a geo-pressured aquifer the fraction of enhanced gas recovery beyond that dissolved in the produced water may seem small, but a recovery attempt is warranted on the basis of the large areal extent of such aquifers and therefore the vast natural gas reserves contained in and possibly recoverable from this type of geo-pressured aquifer.

Some geo-pressured aquifers, as shown in FIG. 2, contain free-gas saturation which is considered marginal or non-commercial for water-free natural gas production and which is equivalent to a watered-out natural gas reservoir. Thus, the desirable gas-phase saturation will exist in the sand and natural gas liberated from solution in the water, upon pressure drop in the aquifer, will be mobile and free to move to the producing well in a separate gas phase independent of the water flow. The gas-phase saturation in a water-flooded natural gas reservoir is considered by reservoir experts to be on the order of 25% to 45% of the flooded pore volume. Therefore, while there is a greater total volume of natural gas contained in the aquifers of the types shown in FIG. 1 due to their general distribution over an extensive geographical area, there is a much greater opportunity of higher natural gas recovery per barrel of water produced from the aquifers of the type shown in FIG. 2.

The present invention by providing for a large water removal rate by expansion of the water in the geo-pressured aquifer lowers the pressure on the bulk of the water remaining in the aquifer sufficiently to allow natural gas to be released from solution from the water, to allow the gas phase in the pore spaces (form 2) to expand and become a larger fractional volumetric saturation, and to allow a portion of both the existing gas-phase natural gas (form 2) and the disdissolved natural gas (form 1 becoming form 2) to flow to the well(s) and be produced and recovered. Preferably, it is desired to produce the wells initially at a high enough rate of production, and as quickly as possible, to reduce the working bottom-hole pressure of the wells to the minimum flowing bottom-hole pressure necessary to maintain flow in artesian fashion and maintain the high rates of water production so the natural gas will be released from solution in the water and will migrate more freely to the well and be produced. This reduction in pressure results in the minimum of water production and disposal commensurate with the greatest recovery of natural gas. Whether or not an initial gas phase exists in a geo-pressured aquifer, a gas phase is created by lowering the pressure in an aquifer initially containing only gas saturated water, and then the same gas-phase saturation would exist as if it were there initially. At a certain natural gas saturation, some movement of natural gas is expected independent of the normal water movement rates. When the gas phase starts moving more rapidly than the water towards the well bore, it is expected that the buoyant effect of the gas will cause the bubbles to rise, and a movement of this type would create a higher gas saturation at some locations in the aquifer, for example, along the underside of layers impervious to the vertical movement of gas. Increased gas saturation under these layers could provide conduits for gas flowing towards the well bore. Another mechanism of gas production beyond that dissolved in the water might be gas movement in a layer or layers where its concentration has increased beyond that necessary for gas to flow independent of water flow. However, even in the absence of impervious layers the natural gas will be induced to move to the well(s).

Figure 3:
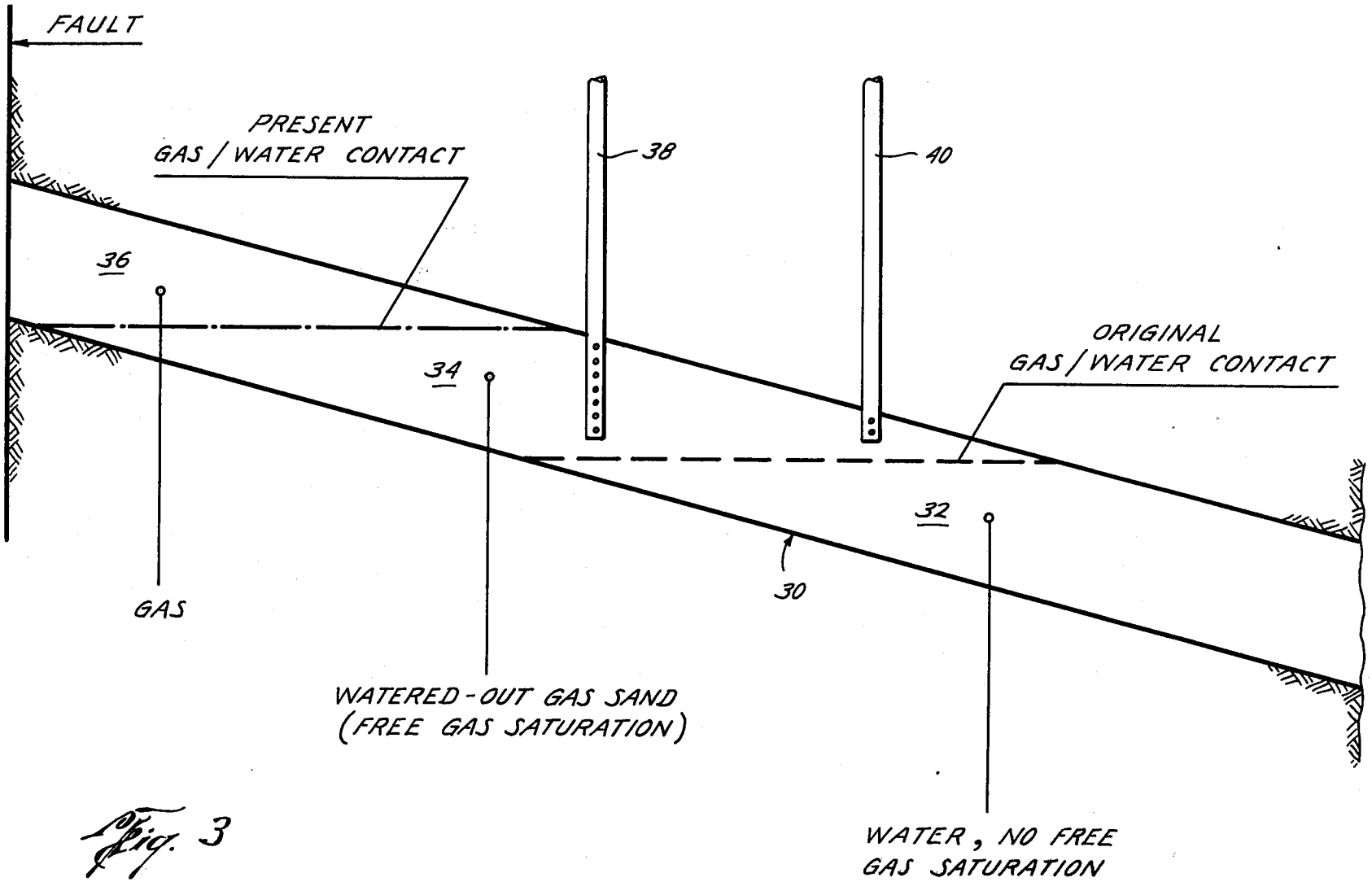
FIG. 3 is an elevational cross-sectional view of a watered-out reservoir having gas in all three forms.

Referring now to FIG. 3, a cross-sectional view of a natural gas reservoir, which has been invaded by natural water-drive or water influx, is shown, in which the geo-pressured reservoir generally indicated by the reference numeral 30 containing a section 32 having water in which natural gas is dissolved similar to that illustrated in FIG. 1. The reservoir 30 also contains a section 34 containing watered-out natural gas sand, that is, water in which natural gas is dissolved along with a free-gas phase, such as illustrated in FIG. 2, dispersed in the water. In addition, the reservoir 30 is shown as including a section 36 containing an unrecovered gas phase. The reservoir 30 is typical of a reservoir where natural gas production through wells 38 and 40 has ceased due to water incursion. The present invention is particularly applicable to the reservoir 30 since the previously drilled and depleted wells 38 and 40, which are already in the free-gas saturation zone or section 34, may be used without requiring the drilling of additional expensive wells. Thus, water would be produced from the wells 38 and/or 40 at a high rate of production to reduce the working bottom-hole pressure of the wells so that the natural gas in the sections 32 and 34 will be released from solution in the water and will migrate more freely than the water to the wells 38 and 40 and be recovered. The dispersed free-gas saturation in section 34 of the reservoir 30 will expand in response to the pressure reduction and a portion of this dispersed free gas will become mobile, move, to the well(s) and be recovered. Furthermore, the lowering of the pressure in the reservoir 30 will allow a portion of the natural gas in the section 36 of the reservoir to expand and flow to well 38 and be recovered as well as the gas in section 34 which expands and a portion of which becomes mobile. Some of the gas which is disdissolved in section 32 will find conduits through section 34 and more readily migrate to the wells and be recovered.

A reservoir engineering calculation has been made on a bounded hypothetical geo-pressured aquifer to determine the minimum quantity of natural gas that could be recovered from water produced from the aquifer and also to detemine the maximum quantity of natural gas that can be recovered if the gas can migrate through the aquifer to the well bores after evolution from the water due to aquifer pressure reduction.

Figure 4:
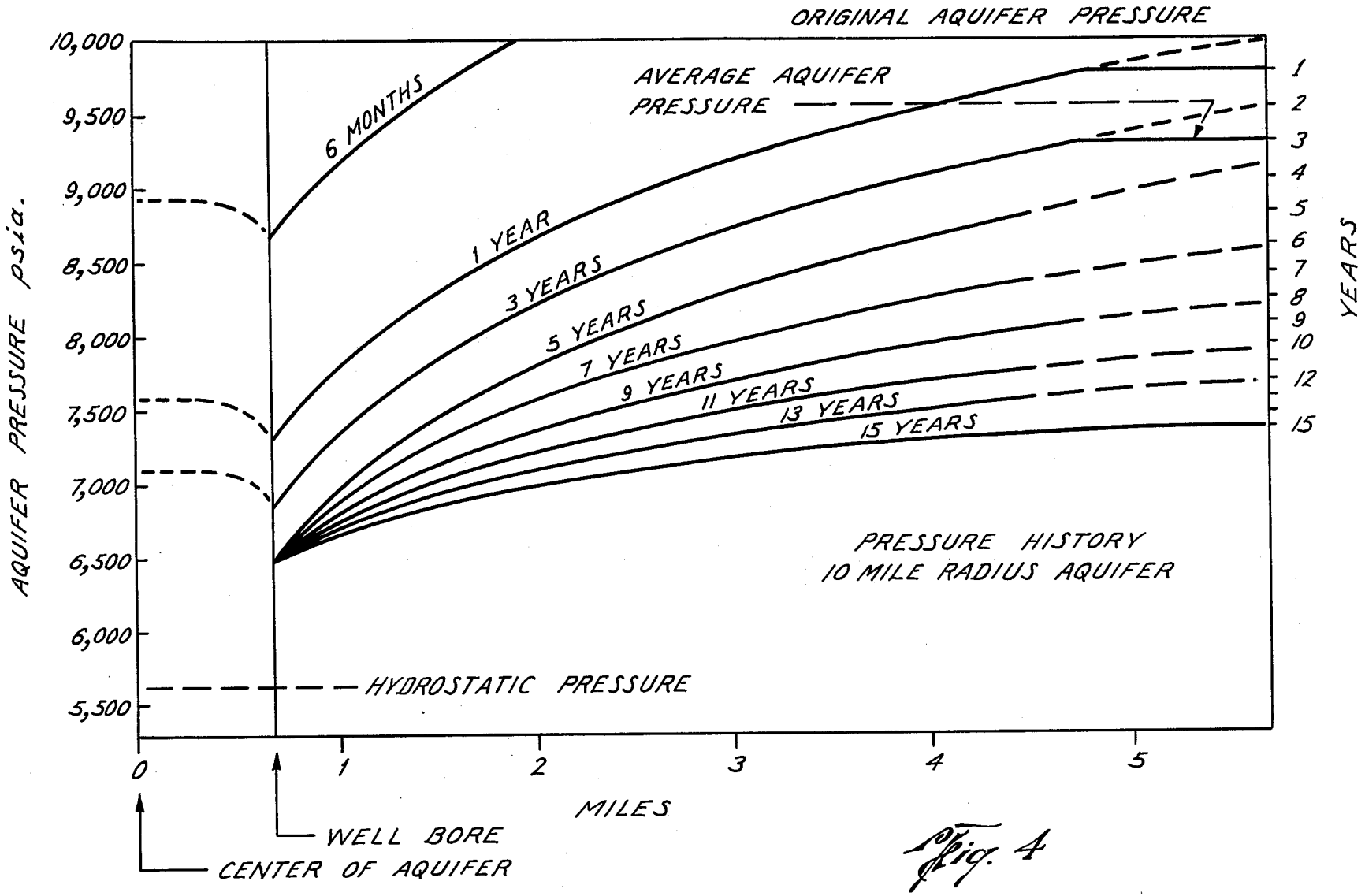
FIG. 4 shows the pressure response of a geo-pressured aquifer when subjected to an intentional, abnormally high water production rate.
Figure 5:
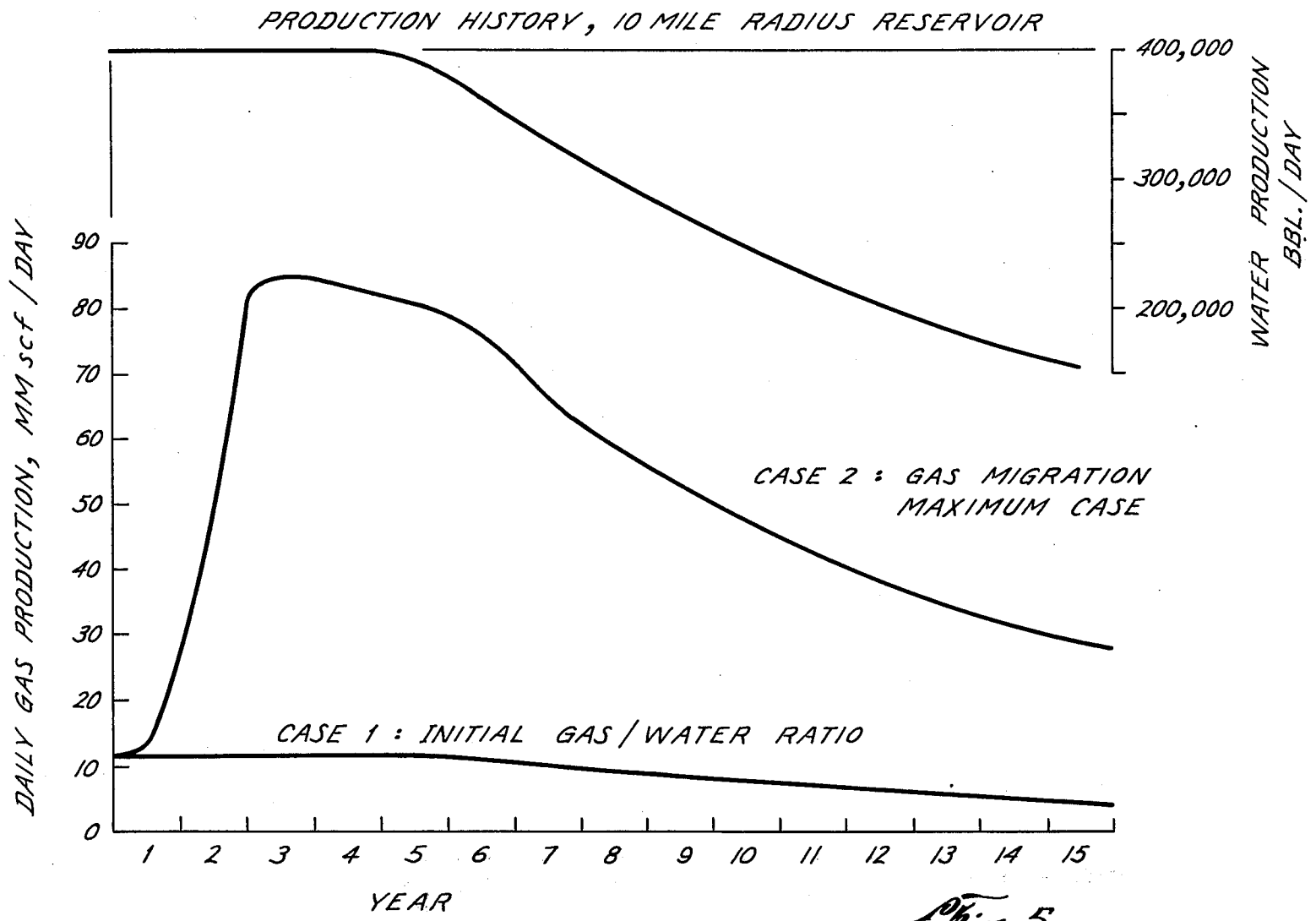
FIG. 5 is a graph illustrating gas recoveries from the aquifer of FIG. 4.

The solution is set forth in the graphs of FIGS. 4 and 5, and the table in FIG. 6 for a large hypothetical circular geo-pressured aquifer with the following characteristics:

| | | | |
|---|---|---|---|
| Radius | 10 miles | Temperature | 300° F |
| Thickness | 200 feet | Porosity | 20 % |
| Depth | 12,000 feet | Permeability | 200 md |
| Pressure | 10,000 psi | Water Salinity total dissolved solids | 100,000 ppm |

To produce this aquifer an eight-well cluster is used, the wells being on a circle whose diameter is 1.3 miles. Each well produces 50,000 barrels of water per day by natural flow against 1000 psi separator pressure. When the flowing wellhead pressure at the surface reduces to 1000 psi, the water production rate is reduced as necessary to maintain this minimum wellhead pressure to allow 1000 psi gas to be introduced into a pipeline without requiring further energy consumption for compression, and the produced water is disposed of without requiring energy for pumping.

FIG. 4 shows the pressure response of the aquifer to this high water production rate of 400,000 bbl/day.

The calculations are based on saturation of the aquifer water initially with natural gas (in solution with the water) at original pressure and temperature. As the pressure drops in the aquifer in response to production, gas evolution occurs - gas bubbles out of the water.

FIG. 5 demonstrates two possibilities for natural gas recovery from this aquifer whose water is initially saturated with gas and whose pressure response is that of FIG. 4. In FIG. 5, daily production rates of water and gas are plotted versus time in years. The curve 3 at the top of the graph represents the daily rate of water production - 400,000 bbl/day initially, reducing after four years in order to maintain the wellhead flowing pressure of 1000 psi. Curve case 1 is the daily rate of natural gas production if the initial solution gas/water ratio be maintained throughout the production time shown. As has been discussed, this is the analysis that others have made of the natural gas recovery from aquifers of this type.

Curve case 2 represents the daily rate of natural gas production when the gas evolved in the aquifer is mobile and can migrate to the well bore in accordance with the present invention.

The table in FIG. 6 shows the production rates of natural gas and water under the two mechanisms controlling gas recovery as discussed above. As can be seen in case 1, utilizing conventional evaluations, the natural gas recovery is about 3% of the gas initially contained in the aquifer. However, in case 2, utilizing applicants' method, the natural gas recovery is about 13.5% of the gas initially contained in this aquifer. The water produced in both cases represents about 3% of that initially in the aquifer.

As has previously been mentioned, it is desirable to reduce the bottom-hole well pressure in the aquifer as fast as possible. However, referring to FIGS. 4, 5, and 6, even with the wells having an initial water production of 50,000 barrels per day per well, it will take almost one year to reduce the flowing bottom-hole well pressure 25%, that is, from 10,000 psia to 7500 psia (FIG. 4) in order to obtain enhanced gas recovery, and in fact, the effect of enhanced gas recovery does not reach maximum until about 3 years. This early reduction of aquifer pressure also allows the enhanced gas recovery with minimum water production and disposal.

The aquifer considered in FIGS 4, 5 and 6 is very large containing initially more than 60 billion barrels of water. A smaller hypothetical aquifer was evaluated in order to obtain the anticipated natural gas recovery and pressure response of the aquifer at a more moderate water production rate.

The smaller bounded aquifer chosen for evaluation had the following characteristics:

Radius = 3 miles, all other parameters same as for large aquifer.

Figure 7:
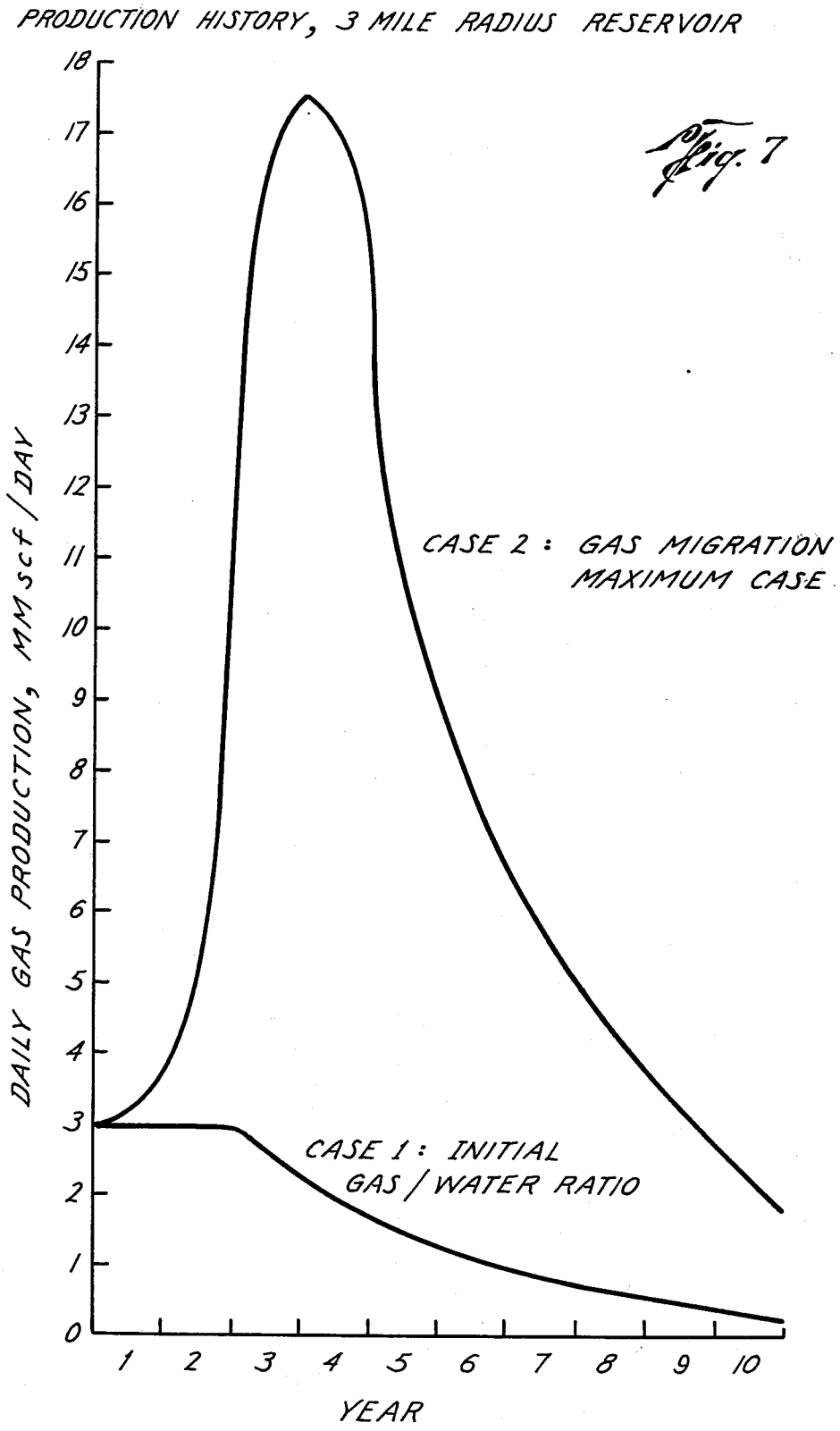
FIG. 7 is a graph illustrating gas recoveries from another aquifer.

Production from this aquifer is accomplished with two wells, eah producing 50,000 bbl/day of water. FIG. 7 represents the ranges of natural gas recovery possible from the aquifer.

As before, the curve for case 1 represents natural gas production at the original gas/water ratio. The curve for case 2, as before, represents the gas production with natural gas migration through the aquifer to the well with the same relative flow capacity (water to gas) as in FIG. 5. The table in FIG. 8 shows the production rates of natural gas and water under the two mechanisms controlling gas recovery discussed above. As can be seen in case 1, the natural gas recovery is about 3% of the gas initially contained in the aquifer. However, in case 2, utilizing applicants' method, the natural gas recovery is about 14% of the gas initially contained in this aquifer. The water produced in either case represents about 3% of that initially in the aquifer. It should be noted that in this case, 11% of the gas recovered was disdissolved from water never produced and this gas migrated to the well independently of the produced water.

As can be seen in FIG. 7 and the table in FIG. 8, two wells in approximately one to one and one-half years can establish the long-term water productivity of the aquifer, determine the pressure response of the aquifer to this high rate of water production, allow determination of the aquifer size from production history; and, most important, determine the degree of enhancement of natural gas recovery from the aquifer.

Figure 9:
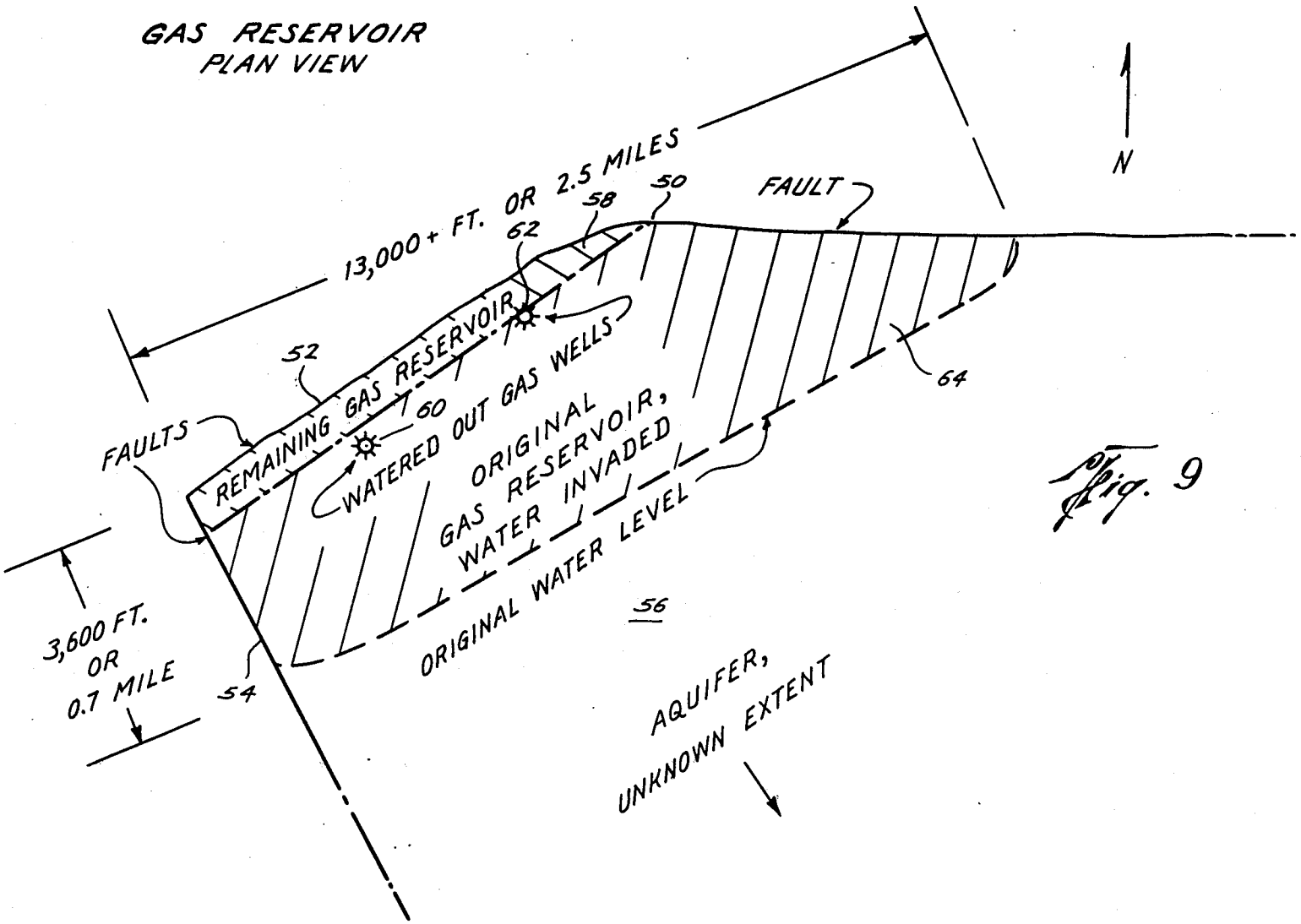
FIG. 9 is a plan view of an actual existing water invaded gas reservoir overlying a geo-pressured aquifer.
Figure 10:
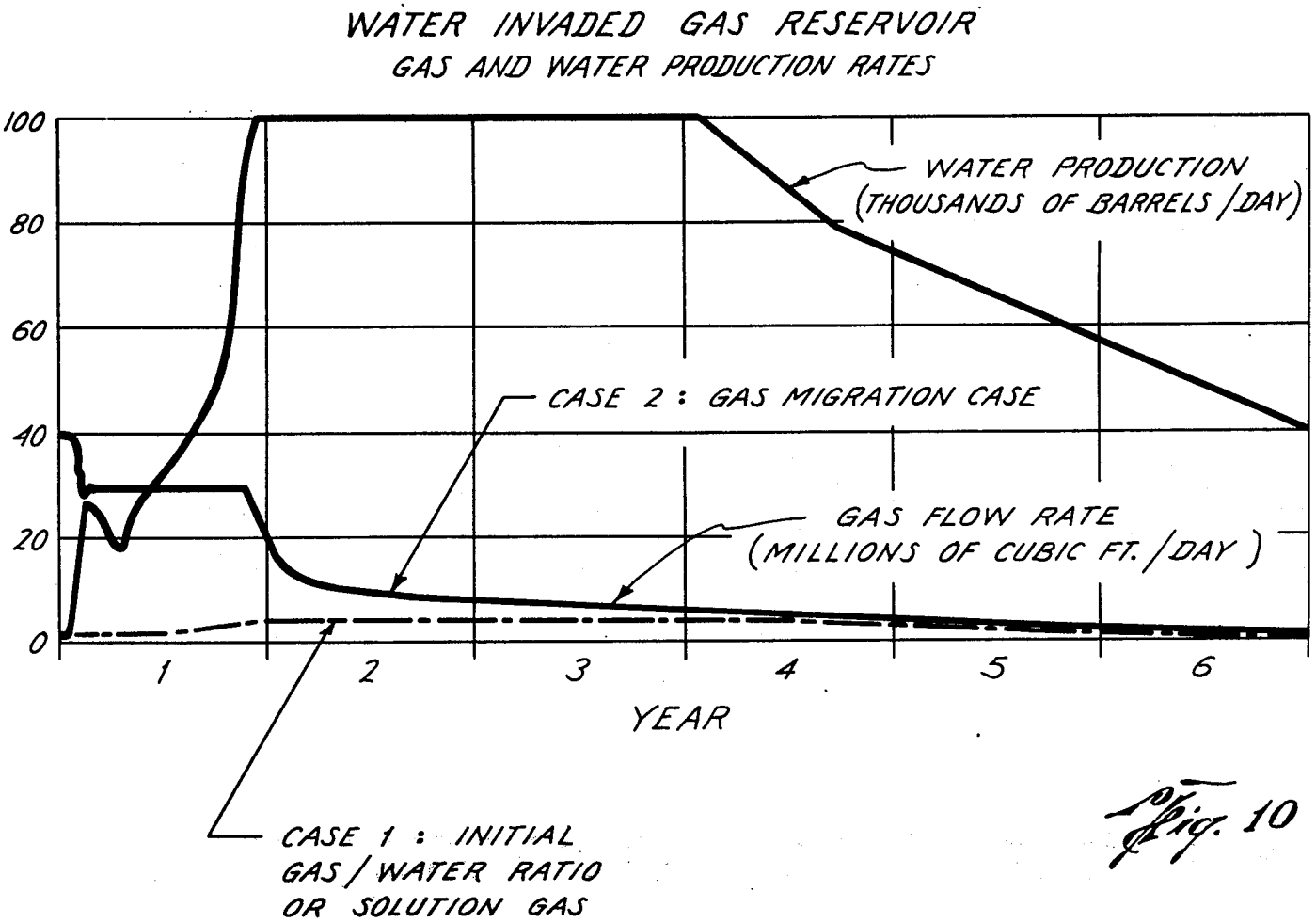
FIG. 10 is a graph illustrating gas recovery from the reservoir of FIG. 9.

Referring now to FIGS. 9, 10 and 11, the application of the present invention is shown as it is proposed to be used with an actual gas reservoir. Referring to FIG. 9, an actual gas reservoir, generally indicated by the reference numeral 50 is positioned between faults 52 and 54 and a large aquifer 56. Gas production has taken place over a period of 12 years, and water from the aquifer 56 underlying the gas reservoir 50 has invaded the gas reservoir 50, replacing the produced gas. The reservoir 50 is at a depth greater than 15,000 feet below the land surface. The reservoir 50 is highly geo-pressured, the original pressure being approximately 14,000 pounds per square inch. After gas production and water invasion for 12 years, the present pressure is approximately 12,500 psi and the only continuous free-gas phase remaining is above the two watered-out gas wells 60 and 62 in reservoir section 58. The original gas reservoir section 64 has been invaded by water and gas exists in the form of dispersed free-gas saturation in the section 64 as well as solution gas in the water. The aquifer section 56 contains solution gas in the reservoir water.

The reservoir characteristics are as follows:

Porosity: 21%
Dispersed free-gas saturation in invaded area 64: 20.7%
Permeability: 200 md.
Average sand thickness: 65 feet.

In this actual reservoir, it is proposed to use the two watered-out wells 60 and 62 which extend into reservoir section 64 which is the zone of free gas dispersed or saturated in water.

As indicated in FIG. 11, reservoir engineers have estimated that the remaining free gas in section 58 of the reservoir is 13,187 MMscf. However, with the gas wells 60 and 62 watered out, it is not economical to drill a new well, at an estimated cost of several million dollars. The reservoir engineers also estimate that there is residual gas saturation in the water in section 64 in the amount of 24,440 MMscf, but its recovery is not possible under conventional production techniques. It is further estimated that the solution gas in the reservoir section 64 is 1,900 MMscf.

Because of the already existing watered-out gas wells 60 and 62 extending into the dispersed free-gas saturation section 54 and the large volume of gas in this section, the treatment of the reservoir 50 by the present method is highly attractive. The present method proposes to allow the aquifer to flow water and gas under natural pressure through the wells 60 and 62 in accordance with the water production schedule shown in FIG. 10. The results of the graph of FIG. 10 and the chart of FIG. 11, for cases 1 and 2 have been calculated by a computer. As before, case 1 represents the conventional treatment of the geo-pressured aquifer in which it is concluded that the gas water ratio will remain constant and the amount of gas produced will therefore only vary in proportion to the amount of water produced. However, in accordance with applicant's method, by producing from the water invaded section 64, recovery is obtained of the free gas dispersed in the water (form 2) in section 64, natural gas in solution (form 1) in the water in sections 64 and 56 and free gas in section 58. That is, the pressure drop in the aquifer causes the gas to become mobile and move through the reservoir faster than the water and therefore provides increased or enhanced gas recovery due to the favorable gas/water permeability.

In case 1 wherein the geo-pressured aquifer is treated conventionally, a cumulative total production is estimated to be 5,162.9 MMscf. On the other hand, case 2 utilizing the present invention of producing water and gas from the dispersed free-gas saturation zone 64, a cumulative total production is estimated to be 17,500 MMscf which provides a gas recovery factor of 44%.

Various studies and calculations have been performed on various types of reservoirs to determine what operating conditions are necessary to obtain sufficient gas saturation so that the gas can become mobile and move through the reservoir formation faster than the water whereby the enhanced gas recovery of the present method can be obtained. It has been found that a minimum flow rate of at least 15,000 barrels of water per day is necessary along with a reduction of existing bottom-hole well pressure by at least 25 percent in order to provide the necessary gas saturation to obtain the gas mobility necessary to provide the enhanced gas recovery of the present method.

The present invention, therefore, is well adapted to carry out the objects and attain the ends and advantages mentioned as well as others inherent therein. While a presently preferred embodiment of the invention is given for the purpose of disclosure, numerous changes in the steps of the process depending upon aquifer conditions encountered will readily suggest themselves to those skilled in the art and which are encompassed within the spirit of the invention and the scope of the appended claims.

What is claimed is:

1. A method of increasing the recovery of natural gas from a geo-pressured aquifer containing water and gas in solution in the water and a zone of free gas dispersed in water comprising, providing one or more wells extending from the surface and completed in the geo-pressured aquifer in said zone, allowing the geo-pressured aquifer to flow water and natural gas under aquifer pressure through the well so as to lower the pressure in the aquifer sufficiently to allow a portion of the free gas dispersed in the water and a portion of the gas in solution to be released from the water whereby the released natural gas will migrate more freely to the well and be produced.

2. The method of claim 1 wherein, the existing bottom-hole pressure of said wells is reduced by at least 25 percent within 1 year.

3. The method of claim 1 including, allowing the aquifer to initially flow water from each of the wells at a rate of at least 15,000 barrels of water per day.

4. The method of claim 1 including, recovering through said well hydrocarbon liquids present in the aquifer.

5. A method of increasing the recovery of natural gas from a geo-pressured aquifer containing water and gas in solution in the water and a zone of free gas dispersed in water comprising, providing one or more wells extending from the surface and completed in the geo-pressured aquifer in said zone, producing water from the wells at a high enough rate of production for obtaining a low bottom-hole working pressure in said wells while maintaining artesian flow of water to cause a portion of the free gas dispersed in the water and a portion of the gas in solution to be released from the water whereby the released natural gas will migrate more freely to the well and be produced.

6. The method of claim 5 including, allowing the aquifer to initially flow water from each of the wells at a rate of at least 15,000 barrels of water per day.

7. A method of increasing the recovery of natural gas from a geo-pressured aquifer containing water and gas in solution in the water and a section having dispersed free saturation in the water comprising, providing one or more wells extending from the surface and completed in the geo-pressured aquifer in said section, producing water from the wells at a high enough rate of production to reduce the existing bottom-hole pressure of the wells by at least 25 percent whereby a portion of the free gas dispersed in the water and a portion of the gas in solution will be released from the water and the released gas will migrate more freely to the well and be produced.

8. The method of claim 7 wherein the initial flow rate from each of the wells is at least 15,000 barrels per day of water.

9. The method of claim 8 including, recovering hydrocarbon liquids through wells present in the aquifer.

10. A method of increasing the recovery of natural gas from a geo-pressured aquifer containing water and gas in solution in the water and a zone having dispersed free gas saturation in the water comprising, providing one or more wells extending from the surface and completed in the geo-pressured aquifer in said zone, producing water from the wells, under aquifer pressure, at an initial flow rate from each of the walls of at least 15,000 barrels per day of water, reducing the existing bottom-hole pressure of the wells by at least 25 percent whereby a portion of the free gas dispersed in the water and a portion of the gas in solution will be released from the water and the released gas will migrate more freely to the well and be produced, and maintaining the initial flow rate and reducing said pressure by said 25 percent within 1 year.

* * * * *